United States Patent [19]

Lohe

[11] Patent Number: 4,829,922

[45] Date of Patent: May 16, 1989

[54] SEWING MACHINE WITH A NEEDLE BAR JOGGING FRAME

[75] Inventor: Rainer Lohe, Gross-Zimmern, Fed. Rep. of Germany

[73] Assignee: Kochs Adler Aktiengesellschaft, Fed. Rep. of Germany

[21] Appl. No.: 216,845

[22] Filed: Jul. 8, 1988

[30] Foreign Application Priority Data

Jul. 21, 1987 [DE] Fed. Rep. of Germany ..... 3724004

[51] Int. Cl.[4] ..... D05B 27/06

[52] U.S. Cl. ..... 112/310; 112/311; 112/320

[58] Field of Search ..... 112/320, 311, 310

[56] References Cited

U.S. PATENT DOCUMENTS 989,538 4/1911 Rontke ..... 112/310
2,292,257 8/1942 Zeier .
3,313,258 4/1967 Wulbrede et al. .
3,927,629 12/1975 Vollmar ..... 112/320
4,611,548 9/1986 Hull ..... 112/320 X
4,616,586 10/1986 Scholl .

*Primary Examiner*—Andrew M. Falik
*Attorney, Agent, or Firm*—Laff, Whitesel, Conte & Saret

[57] ABSTRACT

In a sewing machine having a needle bar jogging frame in which a needle bar which can be driven with a reciprocating motion in its longitudinal direction is mounted, the jogging frame is in the form of a member of a parallel four-bar linkage. For this purpose the frame is mounted by way of a guide lever and a lever so as to be movable parallel to itself in the heat of the sewing machine. The lever and the guide lever are designed equal in length and arranged parallel to one another. This development creates a simply constructed jogging frame so that the needle bar and thus also the needle are always moved or displaced parallel to themselves in the jogging plane of the jogging frame, irrespective of the stitch length and irrespective of whether the sewing direction is forward or backward to produce lock stitches.

4 Claims, 3 Drawing Sheets

SEWING MACHINE WITH A NEEDLE BAR JOGGING FRAME

FIELD OF THE INVENTION

The invention relates to a sewing machine comprising a needle bar jogging frame in which a needle bar, which is drivable with a reciprocating motion in a longitudinal direction of the needle bar, is mounted, which frame is mounted in a head of the sewing machine by means of a link joint and which is drivable with a swinging motion in a jogging plane coinciding with a workpiece feed direction.

BACKGROUND OF THE INVENTION

Sewing machines of this type are also referred to as needle feed sewing machines. In addition to being provided with needle feed, they can also be provided with a so-called upper feeding device for the workpiece or workpieces to be sewn.

A sewing machine is known from U.S. Pat. No. 2,292,257, wherein the upper area of a jogging frame is mounted by means of a link which is displaceable with a reciprocating motion by means of a crank mechanism approximately in the workpiece feed direction. This makes it possible for the needle to run essentially perpendicular to the workpiece when stitching into the material to be sewn. A disadvantage in this case is that a special drive is required for the mentioned crank mechanism, and that a straight-line motion of the needle can only be achieved in theory with a specific stitch length because the geometry of the crank mechanism for displacing the jogging frame in the jogging plane is invariable. Therefore, a distinct straight-line motion, i.e. displacement of the needle parallel to itself, is not achieved in the case of different stitch lengths. Furthermore, it is impossible to use such a mechanism in sewing machines in which the sewing direction for producing lock stitches can be reversed.

Because of the previously described disadvantages sewing machines having a jogging frame which can be driven with a swinging motion about a link joint have therefore gained a much greater acceptance in practice. With such a sewing machine of the defined type, which is known from U.S. Pat. No. 4,616,586, the swing drive of the jogging frame is effected by way of a needle bar feed shaft which can be driven with a swinging motion and is connected to the jogging frame via a chain of articulated levers. In addition, the jogging frame also bears a presser foot of an upper feeding device, which foot can be driven with a swinging motion together with the needle bar. As a result of the needle bar and needle being pivoted about the swivel axis of the fixed link, the needle undergoes, when stitching into the workpiece to be sewn, a bending load resulting in an increase in needle wear. A further disadvantage is that, as a result of its change in inclination during needle feed, i.e. during feed of the workpiece with the needle having stitched therein, the needle displaces the workpieces, to be sewn together, relative to one another, which can result in the two workpieces, to be sewn together, no longer being flush with one another at the end of a seam.

A zigzag-stitch machine is known from U.S. Pat. No. 3,313,258, wherein a needle bar jogging frame can be moved with a translational reciprocating motion at right angles to the sewing direction, i.e. at right angles to the workpiece feed direction, to produce the zigzag stitch. For this purpose the jogging frame is mounted on a sliding bar. Guidance of a needle bar jogging frame in such a manner in a needle feed direction, i.e. in the workpiece feed direction, is impossible.

SUMMARY OF THE INVENTION

It is an object of the invention to create a sewing machine of the type as defined, wherein, irrespective of the stitch length and of the sewing direction the needle bar is guided and displaced always parallel to itself. It is a further object of the invention to provide such a sewing machine with a simple construction.

This object is solved in accordance with the invention by the features that the jogging frame is a first member of a parallel four-bar linkage, the jogging frame being pivotably connected, at one end, to the link joint via a guide lever which is connected to the jogging frame by means of a link joint and serves as a second member, and the jogging frame being pivotably connected, at the other end, to a bearing fixed in the head serving as a fourth member via a lever which is articulated on the jogging frame by means of a link serving as a third member, and the guide lever and the lever having identical lengths and being arranged parallel to one another.

The design of the jogging frame bearing and guiding means in the form of a parallel linkage results in the needle bar and needle always being moved or displaced parallel to itself in the jogging plane of the jogging frame, irrespective of the stitch length and irrespective of whether the sewing direction is forward or backward to produce lock stitches. A drive of this type can be created in a very simple manner. It is therefore space-saving, robust and simple.

The drive of a jogging frame mounted in the manner according to the invention may be embodied in a particularly simple manner when the lever is connected to a swing drive. When the lever is rigidly connected to a needle bar feed shaft which is drivable with a swinging motion and which, being flush with the fixed bearing of the lever, is connected to the latter, the swinging movement is introduced via the link joint so that, in addition to fulfilling its guiding function, a member of the linkage at the same time fulfills a driving function.

Further advantages and features of the invention will become apparent from the ensuing description of an exemplary embodiment, taken in conjunction with the drawing.

DESCRIPTION OF THE PREFERRED EMBODIMENT

Figure 1:
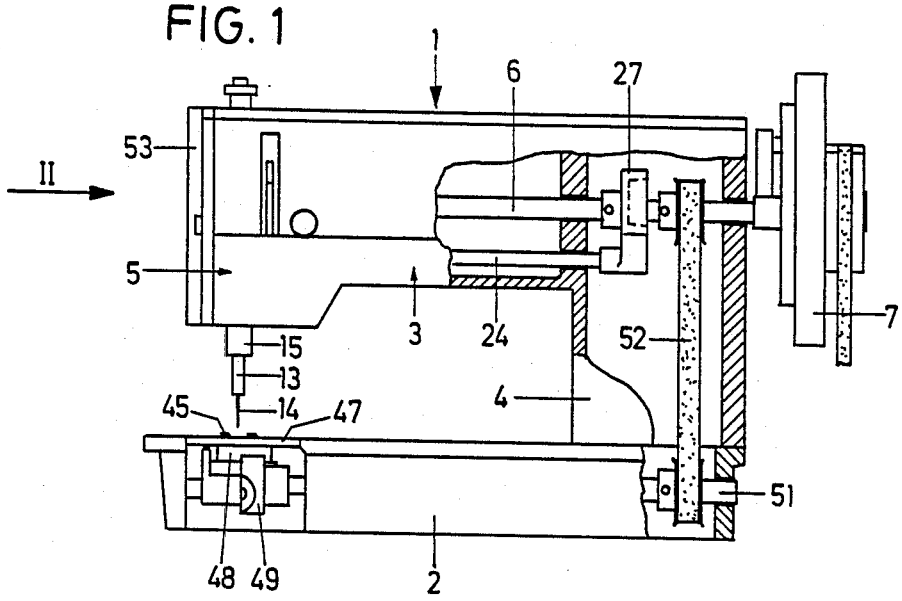
FIG. 1 shows a partially broken away side view of a sewing machine.
Figure 3:
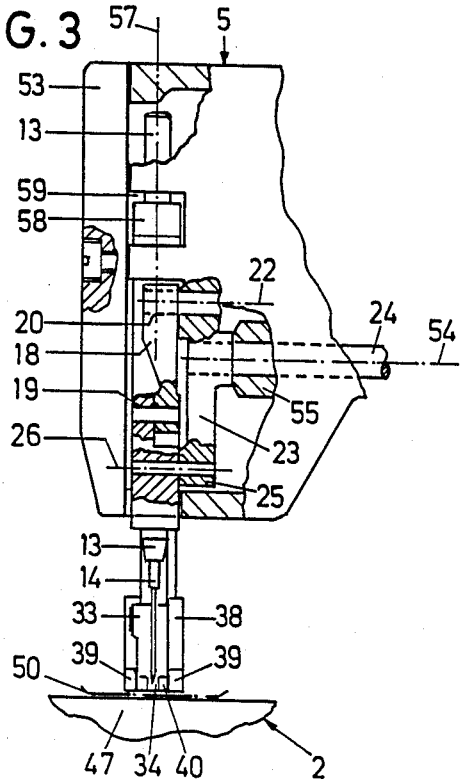
FIG. 3 shows a partial side view of the head of the sewing machine in the direction of arrow III in FIG. 2, in a view partially broken away and cut through different planes.
Figure 4:
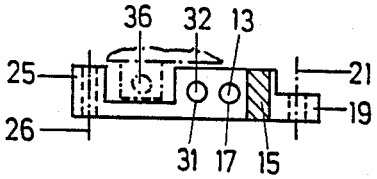
FIG. 4 shows a partial horizontal section through the head of the sewing machine along the line IV—IV in FIG. 2.

A sewing machine 1 has in the usual manner a base plate 2 and an arm 3 which, at one end, is connected to the base plate via a standard 4 and, at the other end, ends in a head 5. Rotatably mounted in the arm 3 is an arm shaft 6 on which a handwheel 7 is secured on the side of the standard 4 and outside the latter. In the region of the head 5 the arm shaft 6 is provided with a crank 8 which has a crank pin 9 for the pivotable location of a connecting rod 10. The free end of the connecting rod 10 remote from the crank pin 9 is pivotably connected to a needle bar connecting stud 11 which is secured on a vertically arranged needle bar 13 by means of a set screw 12. The crank 8, together with the crank pin 9, the connecting rod 10 and the connecting stud 11, forms a needle bar crank mechanism. At its lower end the needle bar 13 supports a needle 14.

The needle bar 13 is mounted so as to be movable in its longitudinal direction in a jogging frame 15. For this purpose the jogging frame 15 has an upper needle bar bearing 16 situated above the needle bar connecting stud 11 and a lower needle bar bearing 17 situated below the connecting stud 11.

Figure 2:
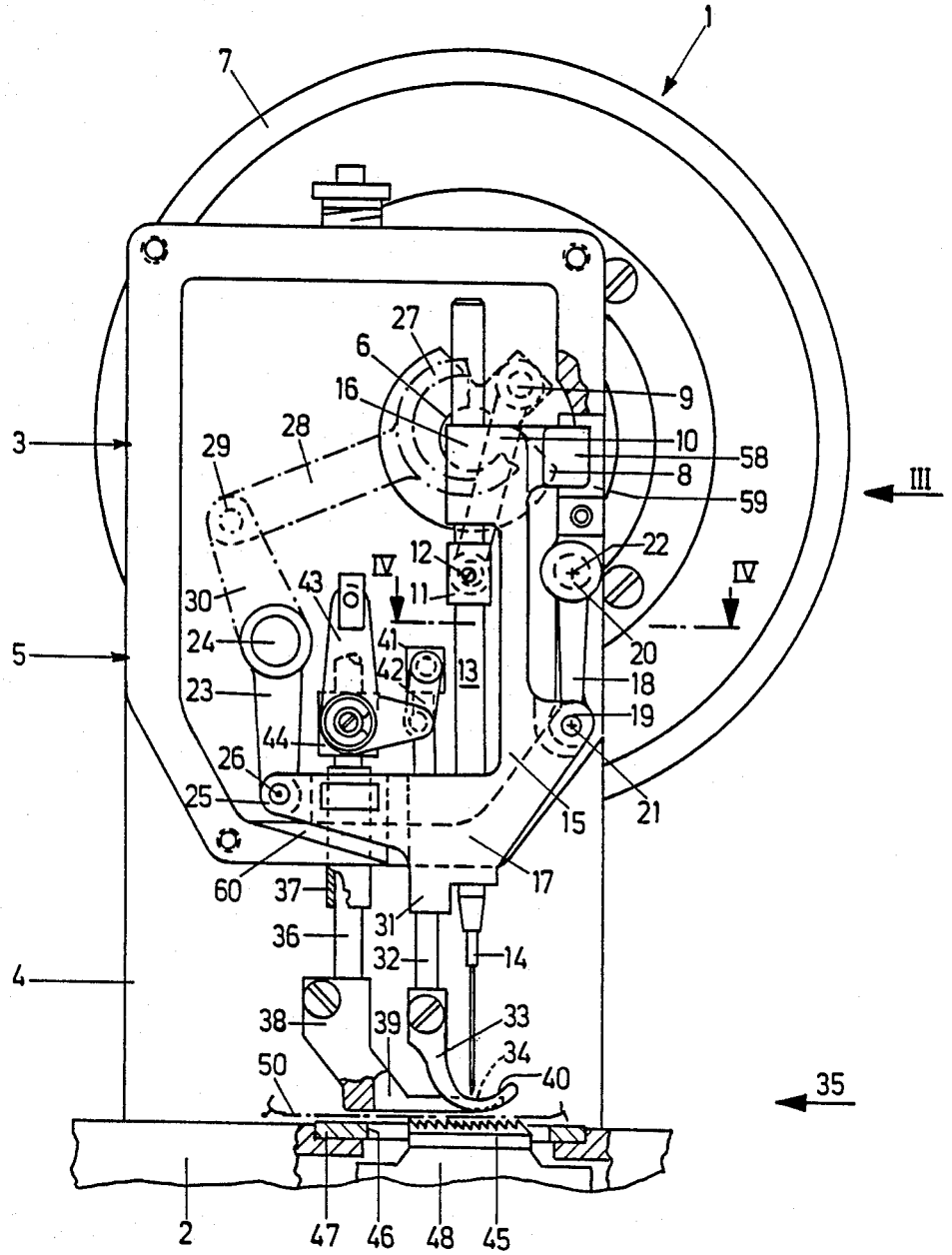
FIG. 2 shows a view of the head of the sewing machine with the cover removed, in the direction of arrow II in FIG. 1.

The jogging frame 15 is mounted pivotably relative to the head 5 or arm 3 by means of a guide lever 18 on one side—the right hand side in FIG. 2. For this purpose this guide lever 18 is articulated on the jogging frame 15 by means of a link joint 19 and, at its other—upper—free end, is articulated so as to be freely pivotable on the head 5 of the arm 3 by means of a link joint 20. The tilt axes 21, 22 of the link joints 19, 20 and thus of the guide lever 18 and, in this respect, also of the jogging frame 15 run parallel to the arm shaft 6.

On its other side—the left hand side in FIG. 2—the jogging frame 15 is connected to a needle bar feed shaft 24 by means of a lever 23. For this purpose this lever 23 is rigidly mounted on the shaft 24. Its lower free end is pivotably connected to the jogging frame 15 by means of a link joint 25. The axis of rotation 26 of this link joint 25 and the shaft 24 also extend parallel to the arm shaft 6.

The drive of this needle bar feed shaft 24 mounted in the arm 3 is derived from the arm shaft 6. For this purpose an eccentric drive 27, which drives the needle bar feed shaft 24 via a tie rod 28 and a lever connected thereto via a hinge joint 29, is attached to the arm shaft 6. For this purpose the lever 30 is rigidly connected to the shaft 24. Because of this design, the jogging frame 15 and thus the needle bar 13 mounted in this frame are driven synchronously to create the reciprocating motion of the needle bar 13.

A slide bearing 31 for receiving a presser foot bar 32 which is movable parallel to the needle bar 13 is formed in the lower area of the jogging frame 15, adjacent to the lower needle bar bearing 17. A presser foot 33 is attached to the lower end of this bar 32. This presser foot 33 has an opening 34 to allow passage of the needle 14. The underside of the movable presser foot 33 is provided with profiling (not shown), for example in the form of teeth. The needle 14 and the movable presser foot 33 are arranged symmetrically with respect to one another in their jogging plane which is predetermined by the swinging motion of the jogging frame 15, this jogging plane being indicated by an arrow 35 in FIG. 2.

Mounted in the head 5 is another presser foot bar 36 in a bearing bushing 37 which is rigidly mounted in the head 5 so that the presser foot bar 36 can only move in its longitudinal direction; it is therefore referred to as the stationary presser foot bar 36. Attached to the lower end of the stationary presser foot bar 36 is a presser foot 38 having two webs 39 which, between them, receive with play the lower area 40 of the movable presser foot 33, which area is provided with the opening 34 and profiling.

At its upper end situated only slightly above its slide bearing 31, the presser foot bar 32 which is slidably mounted in and is movable with the jogging frame 15 is provided with a lug 41 to which an articulated lever 42 is linked, the other end of this lever being in turn articulated on an angle lever 43. A bearing block 44 on which the angle lever 43 is in turn pivotably mounted is secured on the stationary presser foot bar 36.

Symmetrically with respect to the lower area of the presser foot 33 which is movable with the jogging frame 15, there is provided in the base plate 2 a lower feed dog 45 which projects through a recess 46 in a throat plate 47 attached to the base plate 2. The feed dog 45 is attached in the conventional manner to a beam 48 which is moved, in the known manner, with a reciprocating and up- and down motion by a feed mechanism (not shown in detail) so that the feed dog 45 executes an actually approximately elliptical movement, which is usually referred to as a quadrangular movement, during operation of the sewing machine. The needle 14 cooperates with a hook 49, which is arranged in the base plate 2 below the throat plate 47, to produce a seam in a workpiece 50 which is shown by a dot-dash line in FIG. 2.

The lower area 40 of the presser foot 33 which can be driven with a swinging motion is associated with the feed dog 45, the workpiece 50 being received between these two parts. On the other hand, the webs 39 of the non-swingable presser foot 38 only come into contact with the throat plate 47 or the workpiece 50 lying thereon.

The presser foot 33 mounted in the jogging frame 15 is set on the lower feed dog 45 and holds the workpiece 50 firmly on the latter when the jogging frame 15 executes a swinging movement with the needle 14 having stitched into the workpiece. During this phase of movement the non-swingable presser foot 38 is lifted clear of the workpiece 50. If, on the other hand, the needle 14 has not stitched into the workpiece 50, the presser foot 33 is also lifted clear of the work-piece 50. On the other hand, the workpiece 50 is then retained firmly, i.e. generally rigidly, relative to the throat plate 47 by the presser foot 38 which has been lowered on to the workpiece. The drive of the two presser foot bars 32 and 36 with their presser feet 33 and 38 is in the present case of no importance and is known. In this connection reference is made specifically to U.S. Pat. No. 4,616,586.

The hook 49 is driven via a shaft 51 which is mounted in the base plate and can be driven by the arm shaft 6 with the aid of a timing belt drive 52. The drive of the feed mechanism (not shown) for the lower feed dog 45 is also derived from this source.

Figure 5A:
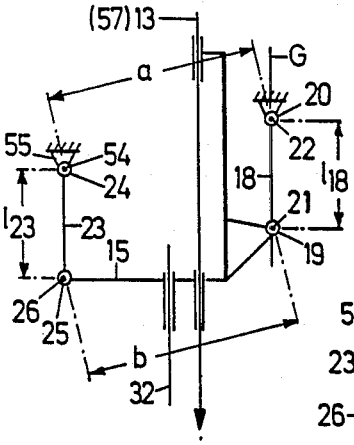
FIGS. 5*a* to 5*c* show diagrammatic views of the jogging frame of the sewing machine in different swing positions.
Figure 5B:
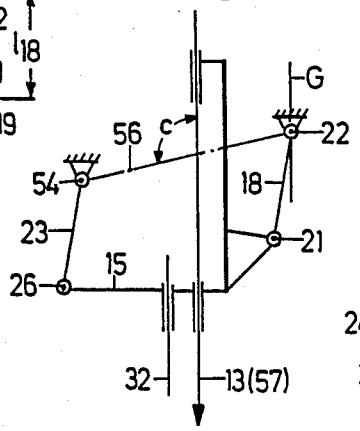
Figure 5C:
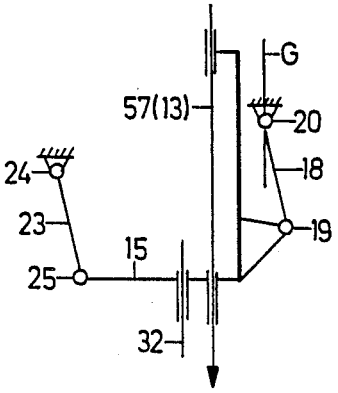

As shown particularly in FIGS. 5*a* to 5*c*, the guide lever 18 and the lever 23 are always arranged parallel to one another. The length $1_{18}$ of the guide lever 18 between the tilt axes 21, 22 of the link joints 19, 20 is therefore identical to the length $1_{23}$ of the lever 23 between the axis of rotation 26 of the link joint 25 and the axis of rotation 54 of the needle bar feed shaft 24 which, inter alia, is mounted rigidly in a bearing 55 in the head 5. Moreover, the distance a between the axis of rotation 54 of the shaft 24 and the tilt axis 22 of the fixed link joint 20 is identical to the distance b of the axis of rotation 26 of the link joint 25 from the tilt axis 21 of the link joint 19. It follows from these two conditions $1_{23} = 1_{18}$ and a=b and from the condition that the axes 54 and 22 are arranged rigidly in the head 5 of the arm 3, that the guide lever 18, the lever 23 and the jogging frame 15 can be moved only parallel to themselves. The needle bar 13, together with the needle 14, is therefore moved by the drive via the needle bar feed shaft 24 always parallel to itself in the direction of arrow 35 or in the opposite direction thereto. FIG. 5*a* shows the jogging frame 15 in a neutral center position. FIG. 5*b* shows the frame in a position which is swung out in the direction of arrow 35, i.e. in the workpiece feed direction, that is at the end of a stitching action by the needle into the workpiece. On the other hand, FIG. 5*c* shows it in a position swung back in the direction of arrow 35, i.e. in the workpiece feed direction, that is at the end of a stitching action by the needle into the workpiece. On the other hand, FIG. 5*c* shows it in a position swung back in the direction of arrow 35, i.e. before the needle 14 stitches or when it begins to stitch into a workpiece 50.

It is evident from the preceding that the jogging plane of the jogging frame 15, which plane is indicated by the arrow 35, lies in the workpiece feed direction, and therefore this direction is also indicated by arrow 35.

It is advantageous if the two fixed axes 54 and 22 and thus also the two tilt axes 21 and 26 associated with the jogging frame 15 are respectively situated at approximately the same level, i.e. if the connecting line 56 between the two fixed axes 54 and 21 and the intermediate longitudinal axis 57 of the needle bar 13 along which the needle bar 13 and 14 are displaced form between them an angle c which is as near as possible to 90°. This means in other words that four axes 21, 22, 26, 54 define an approximate rectangle.

The jogging frame 15 can obviously be driven using adjustable variable swing-out distances, i.e. for different stitch lengths. The corresponding adjusting means are known, for example, from U.S. Pat. No. 4,616,586.

For the sake of completeness it should also be added that the head 5 is closed by means of a screw-on or screw-off cover 53. In the region of its upper needle bar bearing 16 the jogging frame 15 has a projection 58 extending into a recess 59 in the head 5. In the region of the lower needle bar bearing 17 the jogging frame 15 is situated in a recess 60 in the head 5, through which recess the frame projects downwardly. The recesses 59, 60 are each sealed on the outside by the cover 53. In its axial extension in the area of the two recesses 59, 60, the jogging frame 15 is dimensioned in such a way that it is guided so as to be movable in its jogging plane between the bottom of each corresponding recess 59 or 60, on the one hand, and the cover 53, on the other hand, but is guided largely free from play in the direction of axes 21, 22, 26, 54.

What is claimed is:

1. A sewing machine comprising a needle bar jogging frame in which a needle bar (13), which is drivable with a reciprocating motion in a longitudinal direction of the needle bar, is mounted, which frame is mounted in a head (5) of the sewing machine (1) by means of a first link joint (20) and which is drivable with a swinging motion in a jogging plane (35) coinciding with a workpiece feed direction, wherein the jogging frame (15) is a first member of a parallel four-bar linkage, the jogging frame (15) being pivotably connected, at one end, to the link joint (20) via a guide lever (18) which is connected to the jogging frame by means of a second link joint (19) and serves as a second member, and the jogging frame being pivotably connected, at the other end, to a bearing (55) fixed in the head (5) serving as a fourth member via a lever (23) which is articulated on the jogging frame by means of a third link joint (25) serving as a third member, and the guide lever (18) and the lever (23) having identical lengths ($1_{18}$ and $1_{23}$) and being arranged parallel to one another.

2. A sewing machine according to claim 1, wherein the lever (23) is connected to a swing drive.

3. A sewing machine according to claim 2, wherein the lever (23) is rigidly connected to a needle bar feed shaft (24) which is drivable with a swinging motion and which, being flush with the fixed bearing (55) of the lever (23), is connected to the latter.

4. A sewing machine according to claim 1, wherein the parallel four-bar linkage is approximately rectangular-shaped.

* * * * *